US005284403A

United States Patent [19]

Ilomäki

[11] Patent Number: 5,284,403

[45] Date of Patent: Feb. 8, 1994

[54] CONTROL METHOD AND CONTROL EQUIPMENT FOR DRILLING APPARATUS

[76] Inventor: Valto Ilomäki, Loilantie 8, SF-33470 Ylöjärvi, Finland

[21] Appl. No.: 838,793

[22] PCT Filed: Sep. 27, 1990

[86] PCT No.: PCT/FI90/00232

§ 371 Date: Mar. 17, 1992

§ 102(e) Date: Mar. 17, 1992

[87] PCT Pub. No.: WO91/05138

PCT Pub. Date: Apr. 18, 1991

[30] Foreign Application Priority Data

Sep. 27, 1989 [FI] Finland ..... 894558

[51] Int. Cl.[5] ..... E21D 9/00

[52] U.S. Cl. ..... 405/141; 405/138; 405/146; 299/1.3

[58] Field of Search ..... 405/138, 141, 146, 132, 405/150.1; 299/1.3, 1.8

[56] References Cited

U.S. PATENT DOCUMENTS

| | | | |
|---|---|---|---|
| 3,301,598 | 1/1967 | Pirrie et al. | 299/1.3 |
| 3,346,299 | 10/1967 | Meyer | 299/1.3 |
| 3,489,461 | 1/1970 | Lauber | 299/1.3 |
| 4,079,795 | 3/1978 | Sackmann et al. | 299/1.3 X |
| 4,167,289 | 9/1979 | Ono et al. . | |
| 4,343,512 | 8/1982 | Heitkamp et al. | 299/1.3 |
| 4,774,470 | 9/1988 | Takigawa et al. | 299/1.3 X |

*Primary Examiner*—Dennis L. Taylor
*Attorney, Agent, or Firm*—Larson and Taylor

[57] ABSTRACT

A method for controlling advancement of a drilling apparatus comprising a drill head having tools therein and at least one conveying tube is disclosed. The method utilizes changes in pressure sensed in the drill head or the conveying tube as a means for assessing forces acting on tools in the drill head. The measured pressure information is transmitted to control equipment which adjusts the driving force applied by a power unit to the apparatus to effect the drilling operation. The method thereby provides an effective means of preventing damage to the tools.

16 Claims, 4 Drawing Sheets

CONTROL METHOD AND CONTROL EQUIPMENT FOR DRILLING APPARATUS

FIELD OF THE INVENTION

The invention relates to a method for control of the advancement of a tunnel drilling apparatus in soil or rock, by which the forward drive is effected by a power unit which pushes the rear end of the drilling apparatus at the tunnel opening, throughout its traversal of the tunnel. As the tunnel drive advances, the drilling apparatus can be furnished with extensions, from the rear end where the pushing is effected.

BACKGROUND OF THE INVENTION

There is a known control system for a forward driven drilling apparatus, wherein the control of the driving force is dependent on the torque of the drilling apparatus. The tool in the drill head cuts the tunnel front wall through rotation. The rotary motion is transmitted to the drill head from the tunnel opening, in general, by the rotating soil-conveying tubes. The torque of the conveying tube system is monitored and, as the torque drops, the drilling apparatus is driven forward.

An applicable method is also to provide the tool in the drill head with a relatively short feed of its own, the length of which the tool moves on when drilling the tunnel. When the feed travel comes to its end, the tool reverts to start and the entire drilling apparatus is driven forward respectively. This procedure is known, for example, from the GB-publication No. 2 091 316 and the U.S. Pat. No. 4,167,289.

The disadvantage of a torque monitoring control method is the growth of torque when the tunnel drive advances. The farther the tunnel work advances the more the resistance of rotation drops, which can be caused for instance by the conveying tubes transmitting the torque. Therefore, when the tunnel drive advances, the control system becomes insensible to tool hindrances far from the tunnel opening and damage to the tool is quite possible.

In a system where the tool is provided with an individual built-in feed motion in the drill head, the mounting of the tool becomes complicated and even the control system must be of a kind that senses the qualities and variations of soil ahead.

SUMMARY OF THE INVENTION

With the method and apparatus provided by this invention, a crucial improvement of said disadvantages has been achieved. To put this into practice, the method of this invention is characterized in what has been presented in patent claims 1–9, and the apparatus in what has been presented in patent claims 10–16.

It can be considered the main advantage of this invention that feed-back is received uninterruptedly about the relatively great driving force towards the driving power unit rear end and its effect on the drill head. Thereby the driving force is not allowed to rise so much that it could damage the tool. When the drilling apparatus advances in the tunnel, the tool at the drill head is always the first one to hit the tunnel front wall and the impact causes a rise in pressure in the tool supporters and this information is exploited in the invention. With the apparatus according to the invention, the drill head, the conveying tubes as well as the protecting tubes (if used) are fed all the way, uninterrupted, through the tunnel. As per the above mentioned publication, interruption is caused by the step-by-step push of the protecting tubes in order to follow the drill head, since there is no forward drive of the protecting tubes during drilling.

BRIEF DESCRIPTION OF THE DRAWINGS

The invention is more closely described as follows with reference to the drawings in which.

DESCRIPTION OF THE INVENTION

Figure 1:
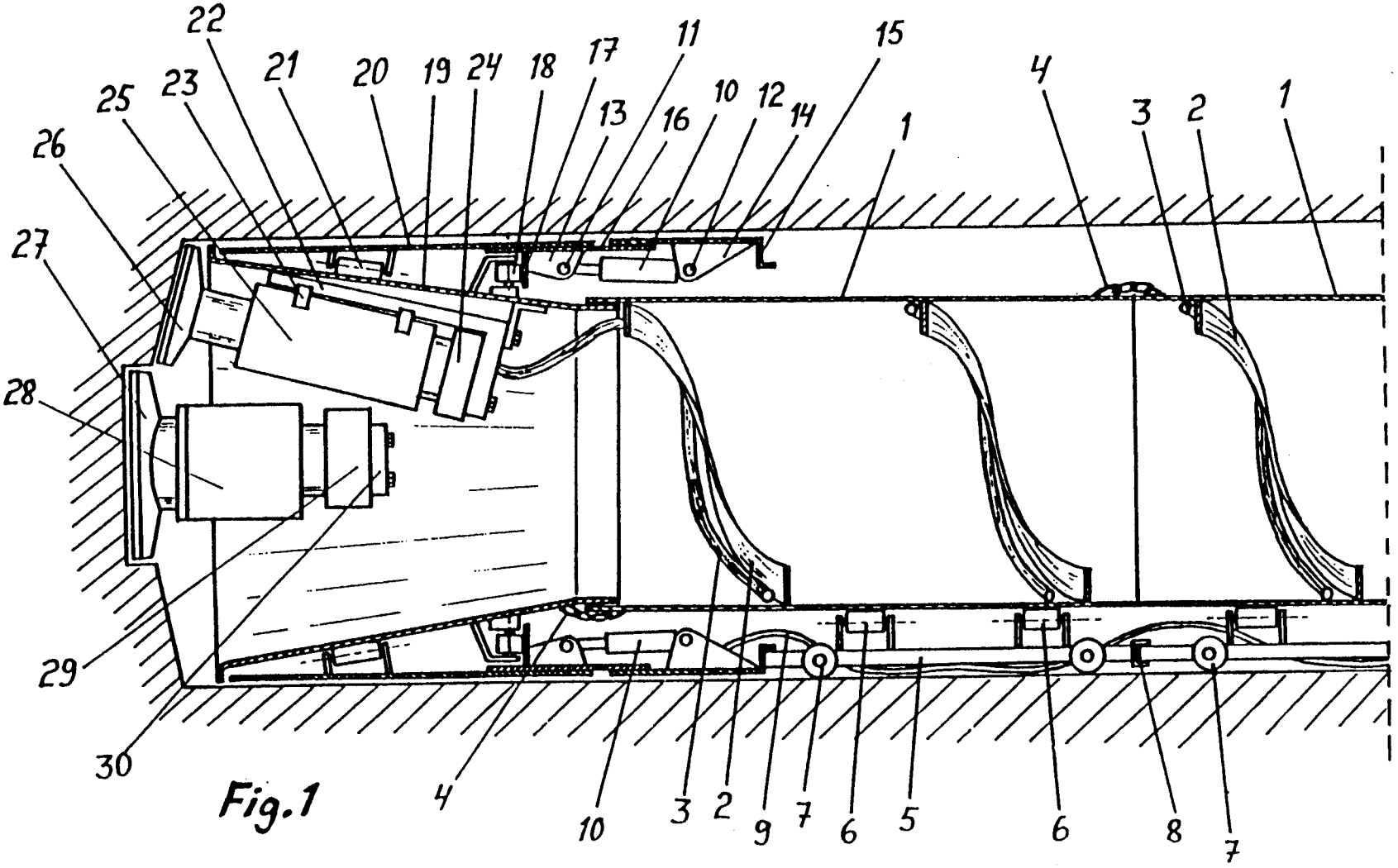
FIG. 1 is a drill head provided with two tools.

FIG. 1 shows a drilling apparatus provided with percussion tools (25 and 28) for drilling a tunnel in rock. These tools are supported against the medium-driven cylinders (24 and 29) and movable in their holders (22 and 30) parallel with their longitudinal axis. Thereby the forces affecting the tool bits (26, 27) parallel with the longitudinal axis, are detectable as pressure in the support cylinders (24, 29). The rotating drill head (19) is supported against the front end drum (20) with rollers (21). A collar ring (17), which is also the support face for the roller (18) which functions as thrust bearing, is fixed to the front end drum (20) by means of an auxiliary drum (16). A medium-driven pressure sensor can also be installed in connection with collar ring (17) or roller (18). Rise of pressure due to forces towards the tool bits (26, 27), can be detected by this sensor and transmitted to the tunnel working pit as pressure information along hose (9) resting on rollers (6) on roller frames (5) provided with wheels (7) at the bottom of the tunnel.

Pressure information can also be transmitted via hoses (3) arranged behind the spiral ribbing (2) in the conveyor drum (1). The chains (4) transmit the torsion from one conveyor drum to another.

For the control of the drill head (19), the head (19) is provided with steering cylinders (10) fastened through joints (11, 12) to the holders (13) and (14). The counter-drum (15) leans on the roller frames (5). The steering cylinders (10) are medium-driven and the pressure towards the cylinder can also be detected as a rise in pressure in these cylinders. The pressure hoses (9) of these cylinders are, preferably, taken to the tunnel working pit along the roller frames (5).

Figure 2:
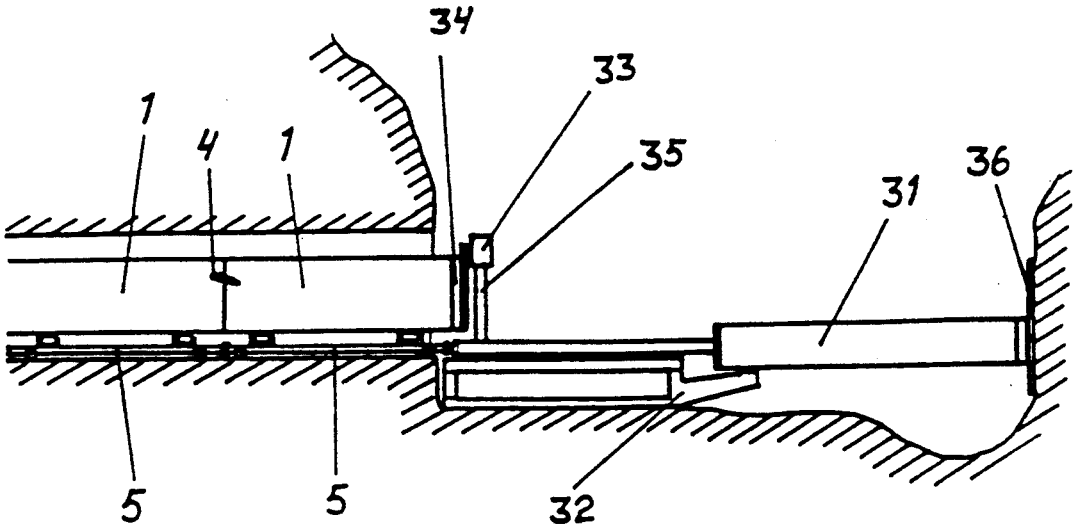
FIG. 2 is a driving power unit in the working pit.

FIG. 2 shows the power unit (31) in the working pit. A cylinder is provided as power unit (31), and rests on the frame (32). The cylinder is supported against the pit back wall with a plate (36). The motor (33) rotates the conveying tube (1) by means of a cog-wheeled annular part (34) in the rear end of the conveyor tube. The entire drilling unit is driven by the cylinder as drilling proceeds, e.g. controlled by pressure information received from actuators.

Figure 3:
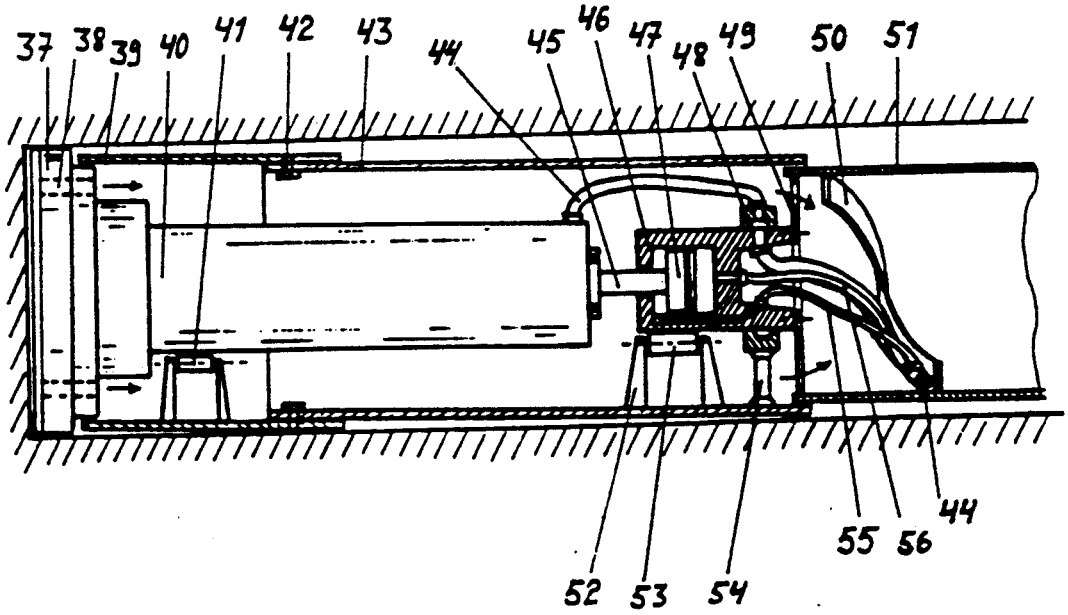
FIG. 3 is a drill head with one tool.

FIG. 3 shows a cylinder (46), which functions as a thrust bearing behind the tool (40) in the drilling head. The tool is enveloped in the protecting tubes (39, 43) which are joined by connecting elements (42) and provided with a drill bit (37) with openings (38). The tool rests on rollers (41) and the cylinder (46) rests on rollers (52, 53, 54). The compressed-air hose (44) and the hydraulic hoses (55, 56) are taken to the drill head behind the ribbing (50) of the rotating conveyor tube (51).

Around cylinder (46) there is an immobile ring (48) provided with an inside groove along which compressed air can uninterruptedly enter the drill head through hose (44) in piston rod (45). Hydraulic pressure is conducted to both sides of piston (47) through holes bored in cylinder (46). The forces towards the tool can be detected as a rise of pressure in the hydraulic cylinder (46) which functions as a thrust bearing in the working pit.

Figure 4:
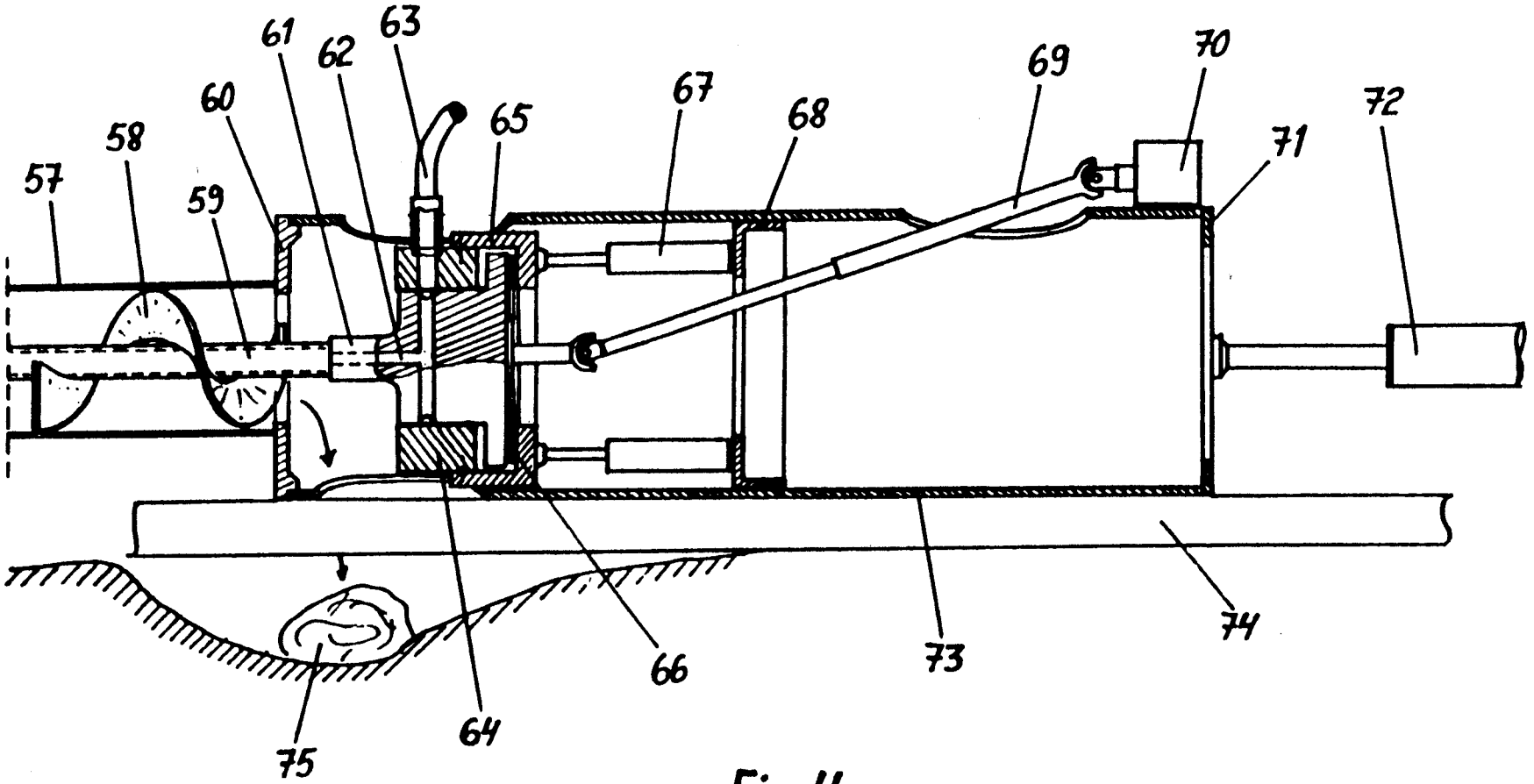
FIG. 4 is a drilling apparatus, where the tool affecting force turns to pressure information in the working pit.

FIG. 4 shows an auxiliary frame (73) placed on framework (74) and driven by the Actual driving cylinder (72) at the rear end (71) of the auxiliary frame (73). Inside the auxiliary frame (73) there is an immobile collar ring (68) from which small-sized cylinders (67) push the thrust bearing part (65, 66), which can slide within the auxiliary frame (73), and a part (64, 61, 62) conducting compressed-air via hose (63). The motor (70) rotates by means of an articulated shaft (69), the center part (61) which is mounted with bearings to rotate within the collar part (64). Inside the protecting tube (57), which is forced into the tunnel, a screw (58) rotates thereby conveying soil or rock (75) out of the tunnel. Simultaneously, the center tube (59) of the screw (58) works as a conducting line (62) for compressed air. A rotating tool in the drill head may be joined directly to the center tube (59) of the conveying drum. Thereby the forces directed toward the tool are transmitted along center tube (59) to the thrust bearing (66) and further over it to the cylinders (67). The flange (60) of the auxiliary frame (73) transmits the driving force of the driving cylinder (72) to the protecting tube (57) but the driving force against the tool must at the same time come through the cylinders (67), whereby it is possible to obtain information about the pressure in the cylinders (24 and 29) from the force toward the tool.

Figure 5:
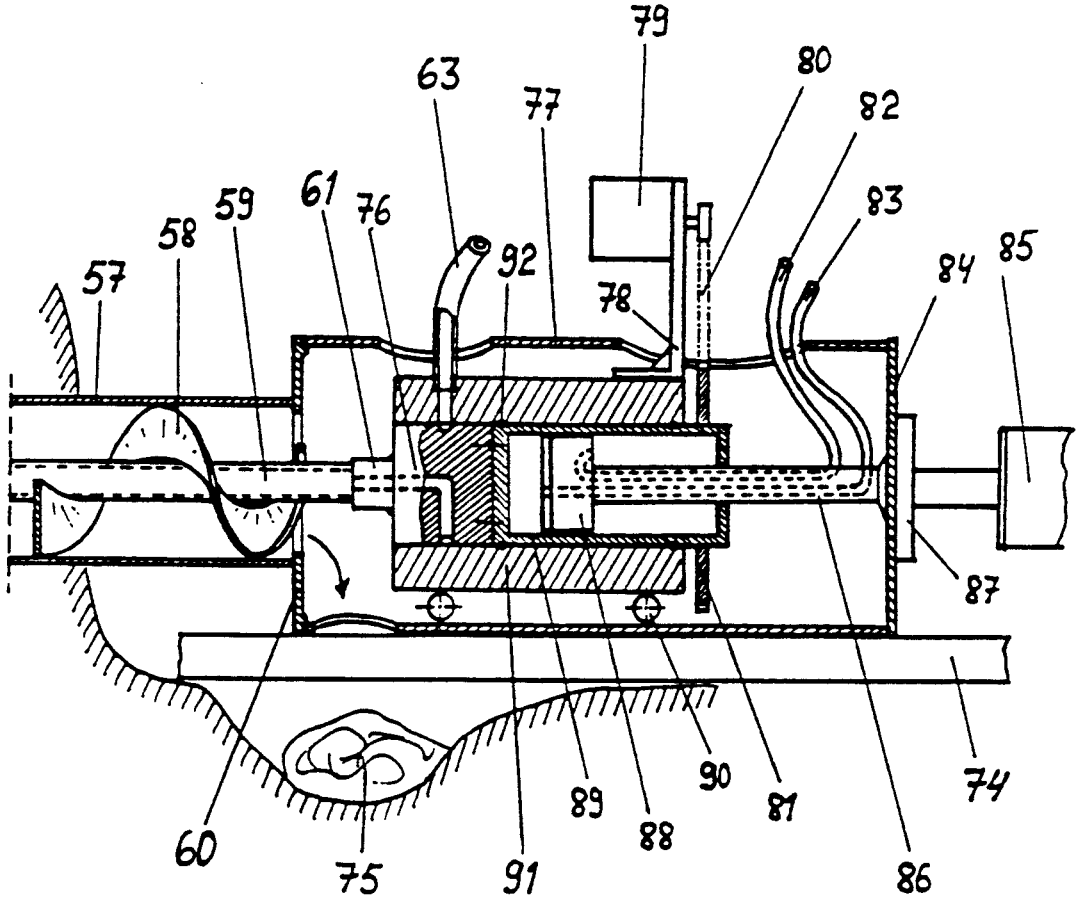
FIG. 5 is a drilling apparatus, where the tool affecting force turns to pressure information in the working pit.

FIG. 5 shows a partial view of the drilling apparatus in the working pit, where the hydraulic cylinder (89) functions as a thrust bearing. The driving cylinder (85) pushes, by means of end pieces (84, 87), the auxiliary frame (77) which can slide upon the framework (74) and which drives the protecting tube (57) into the tunnel. The hydraulic pressure hoses (82, 83) are taken through the hollow piston rod (86) of the cylinder (89) and arranged on both sides of the piston (88). The cylinder (89) and the center part (61) are mounted on bearings to rotate inside the ring (91) provided with packings (92). The thrust bearing unit can move within the auxiliary frame (77) which rests on rollers (90). The motor (79) rotates via chain (80) on a chain wheel (81) fastened via arm (78) on the cylinder surface. The rotation forces toward the tool in the drill head are transmitted to the hydraulic cylinder, which functions as thrust bearing, and can be detected as rise in pressure in the hydraulic system. To the driving cylinder, for instance, adjusted pressure is transmitted over a pressure reduction valve, where the rise of cylinder (89) pressure leads to drop of set-value in the driving cylinder pressure regulating valve or it stops circulation of hydraulic fluid to the driving cylinder.

The control system can also be so arranged that for the actuators which sense tool-affecting forces, a proper constant pressure is set and maintained through adjustment of cylinder pressure. This is a most advantageous method in cases where the drill head is provided with only one rotation producing tool.

This invention is not restricted to the embodiment described in the specification and in the drawings but it can be modified within the limits of the enclosed patent claims. Pressure information from the tool is not necessarily taken all the way to the working pit along pressure hoses but intermediate electric or acoustic wave based communication media can be used.

I claim:

1. A method for controlling advancement of a drilling apparatus comprising a drill head and at least one conveying tube comprising the steps of:

applying a driving force to the apparatus from a rear end of a conveying tube positioned near the entrance of a tunnel by means of a power unit, said power unit remaining substantially immobile, to drive the drilling apparatus into ground;

mounting additional conveying tubes successively at the rear end of the apparatus to increase a length of said apparatus as the apparatus is driven into ground, said driving force being transmitted through said conveying tubes to said drill head;

adjusting driving force in accordance with the length of the apparatus;

measuring changes in pressure in the drill head or the conveying tubes to access forces acting on said drill head;

transmitting said measured changes in pressure to control equipment used for controlling said power unit;

adjusting said driving force as a function of said changes in pressure, whereby damage to said drill head is prevented.

2. The method of claim 1 wherein said step of measuring is performed by sensing pressure in medium-driven guiding cylinders attached to said drill head.

3. The method of claim 1 wherein said step of measuring is performed by sensing pressure in a medium which drives tools in said drill head.

4. The method of claim 1 wherein said step of measuring is performed by sensing pressure in a thrust bearing in the conveying tube.

5. The method of claim 1 wherein said step of transmitting is performed using medium fluid lines or electric communication means.

6. The method of claim 1 wherein said power unit comprises a hydraulic cylinder.

7. The method of claim 6 wherein said step of adjusting is performed by stopping circulation of hydraulic fluid to said cylinder.

8. The method of claim 6 wherein said control equipment comprises an adjustable pressure reduction valve.

9. The method of claim 8 wherein said step of adjusting comprises changing a set point of said reduction valve.

10. In an apparatus for drilling a tunnel comprising a drill head, conveying tubes, a power unit located at a rear end of a rearmost conveying tube positioned near the entrance of a tunnel for supplying a forward driving force to the drill head and conveying tubes and control equipment therefor, the improvement which comprises means for sensing pressure in said drill head or said conveying tubes and means for transmitting pressure measurements to said control equipment for adjusting of said forward driving force to compensate for the addition of conveying tubes.

11. The apparatus of claim 10 further comprising percussion or rotatable tools in said drill head.

12. The apparatus of claim 11 wherein said means for sensing pressure is located in a medium which drives said tools in said drill head.

13. The apparatus of claim 10 wherein said means for sensing pressure is located in medium-driven guiding cylinders attached to said drill head.

14. The apparatus of claim 10 wherein said means for sensing pressure is located in a thrust bearing in said conveying tube.

15. The apparatus of claim 10 wherein said means for transmitting comprises medium fluid lines or electric communication means.

16. The apparatus of claim 10 wherein said control equipment comprises an adjustable pressure reduction valve.

* * * * *